US008109864B2

(12) United States Patent
Tseng

(10) Patent No.: US 8,109,864 B2
(45) Date of Patent: Feb. 7, 2012

(54) ARM EXERCISING DEVICE

(76) Inventor: Chun-Ming Tseng, Taichung (TW)

( * ) Notice: Subject to any disclaimer, the term of this patent is extended or adjusted under 35 U.S.C. 154(b) by 0 days.

(21) Appl. No.: 12/880,451

(22) Filed: Sep. 13, 2010

(65) Prior Publication Data

US 2011/0269604 A1 Nov. 3, 2011

(30) Foreign Application Priority Data

Apr. 30, 2010 (CN) ..... 2010 2 0189341 U

(51) Int. Cl.
*A63B 21/02* (2006.01)
*A63B 21/05* (2006.01)

(52) U.S. Cl. ..... 482/121; 482/126; 482/128

(58) Field of Classification Search ..... 482/121–129
See application file for complete search history.

(56) References Cited

U.S. PATENT DOCUMENTS 4,023,796 A * 5/1977 Kusmer ..... 482/126
4,480,832 A * 11/1984 Bulmash et al. ..... 482/113
4,778,174 A * 10/1988 Tolsma ..... 482/15
4,826,157 A * 5/1989 Fitzpatrick ..... 482/133
5,354,251 A * 10/1994 Sleamaker ..... 482/96
5,597,375 A * 1/1997 Simonson ..... 482/100
5,613,928 A * 3/1997 Laudone ..... 482/139
5,803,880 A * 9/1998 Allen ..... 482/113
6,042,510 A * 3/2000 Miller ..... 482/51
6,095,955 A * 8/2000 Lee ..... 482/112
6,319,179 B1 * 11/2001 Hinds ..... 482/121
6,394,935 B1 * 5/2002 Lake ..... 482/94
6,491,610 B1 * 12/2002 Henn ..... 482/130
6,537,185 B1 * 3/2003 Hur ..... 482/142
6,585,626 B2 * 7/2003 McBride ..... 482/130
6,595,905 B2 * 7/2003 McBride ..... 482/130
6,726,601 B1 * 4/2004 Beutel ..... 482/52
7,182,718 B2 * 2/2007 Wu ..... 482/122
7,226,401 B2 * 6/2007 Van Stratten et al. ..... 482/112
7,250,022 B2 * 7/2007 Dalebout et al. ..... 482/142
7,708,669 B2 * 5/2010 Rodgers, Jr. ..... 482/52
7,892,155 B2 * 2/2011 Pearson et al. ..... 482/121
2003/0114281 A1 * 6/2003 Mackert et al. ..... 482/123
2004/0142798 A1 * 7/2004 Liao et al. ..... 482/126
2006/0100069 A1 * 5/2006 Dibble et al. ..... 482/98
2007/0238590 A1 * 10/2007 Jin ..... 482/121

* cited by examiner

*Primary Examiner* — Stephen Crow
(74) *Attorney, Agent, or Firm* — Nixon & Vanderhye P.C.

(57) ABSTRACT

An arm exercising device includes a frame, a linkage mechanism, and an impeding unit disposed to apply a resistance force to the linkage mechanism. The frame includes an upright support that has a fixed guide rod. The linkage mechanism includes a pair of swing arms pivotally mounted on the upright support for swinging upward and downward, a runner sleeve disposed slidably over the guide rod for movement upward or downward, a pair of linking rods, each connected between the runner sleeve and one of the swing arms, and a force transmitting cord connected to the handgrips and the swing arms. The resistance force applied to each arm of the user who grips both handgrips and pulls downward is applied evenly to enable a smooth exercise to be performed.

11 Claims, 10 Drawing Sheets

ARM EXERCISING DEVICE

CROSS-REFERENCE TO RELATED APPLICATION

This application claims priority of Chinese Utility Model Application No. 201020189341.5, filed on Apr. 30, 2010, the disclosure of which is herein incorporated by reference.

BACKGROUND OF THE INVENTION

1. Field of the Invention

This invention relates to an exercising device, more particularly to an arm exercising device.

2. Description of the Related Art

Referring to FIG. 1, a conventional arm exercising device is shown to include a plurality of elastic straps 91, two swing arms 92 connected to the elastic straps 91, two steel cords 93 disposed for respectively driving movement of the swing arms 92, and two handgrips 94 respectively connected to the steel cords 93. When the handgrips 94 are pulled by a user, a resistance force is generated by the elastic straps 91 to train the user's arm muscles.

Referring to FIG. 2, another conventional arm exercising device is shown to be similar to the above arm exercising device, and has two fluid pressure cylinders 95 to generate a resistance force to impede swing movement of the swing arms 92.

However, in both of these arm exercising devices, the swing arms are moved independently and the impeding units (e.g., the elastic straps 91 and the fluid pressure cylinders 95) are disposed to generate separate resistance forces to each of the respective swing arms 92, thereby resulting in uneven loading of the handgrips 94 and having an adverse effect upon the exercising user.

SUMMARY OF THE INVENTION

An object of the present invention is to provide an arm exercising device which is capable of providing an even and uniform resistance force to train the muscles of a user's arms.

According to this invention, the arm exercising device includes a frame that has an upright support with a fixed guide rod, and a linkage mechanism. The linkage mechanism includes a pair of swing arms pivotally mounted on the upright support for swinging upward and downward, a runner sleeve disposed slidably around the guide rod for moving upward or downward, a pair of linking rods, each connected between the runner sleeve and one of the swing arms, a pair of handgrips, and a force transmitting cord connected to the handgrips and the swing arms.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
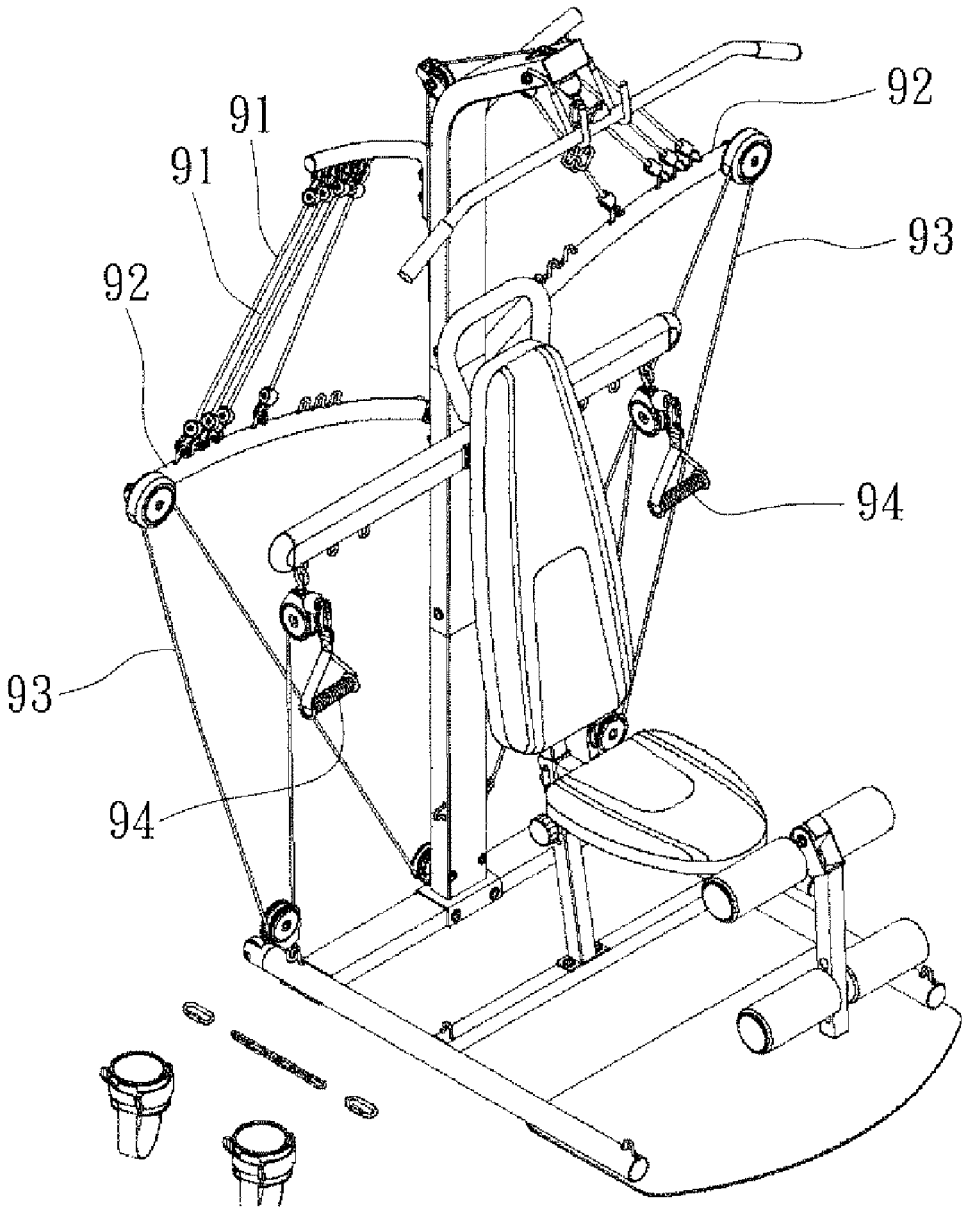
FIG. 1 PRIOR ART
FIG. 1 is a perspective view of a conventional arm exercising device.
Figure 2:
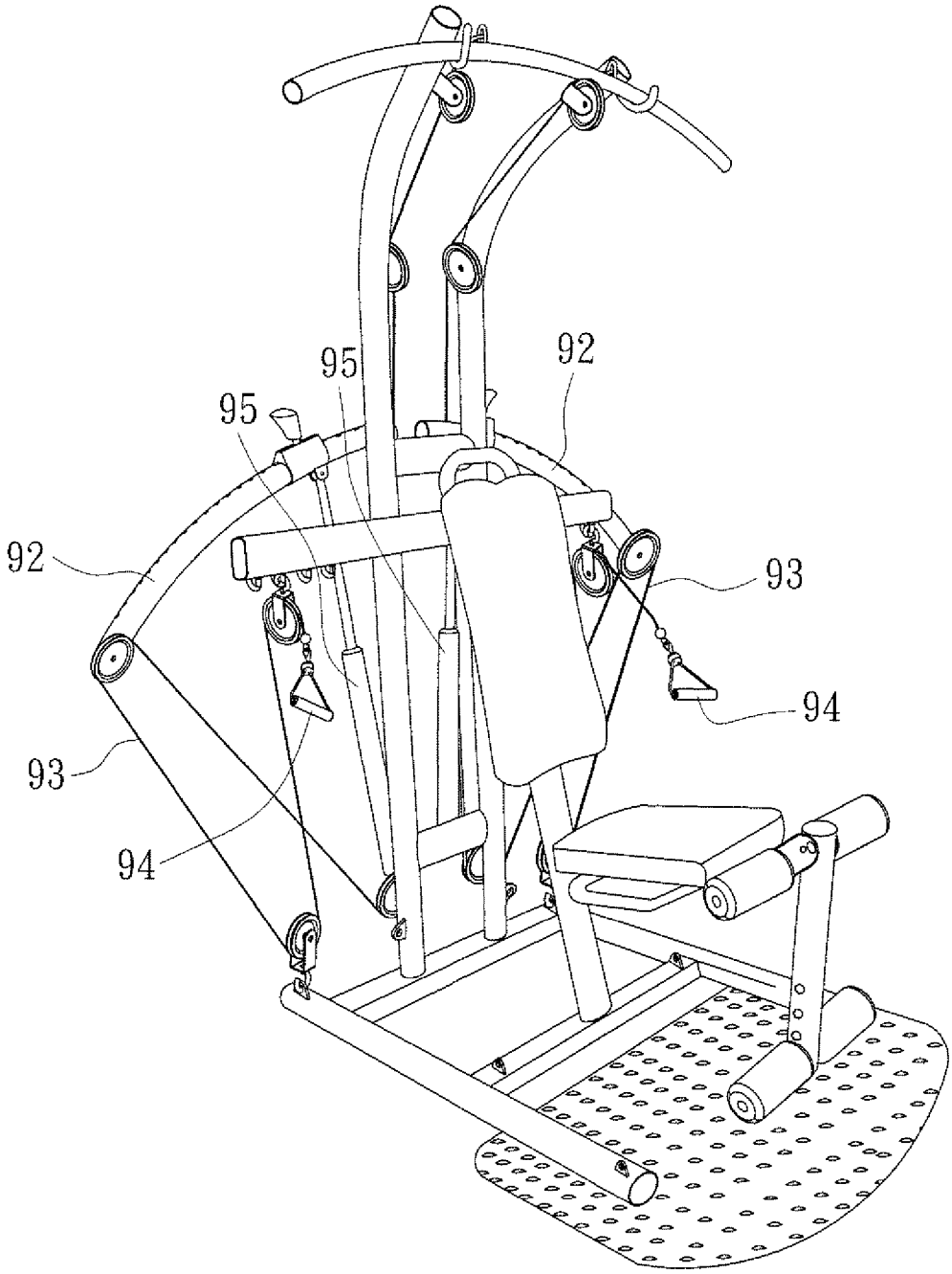
FIG. 2 PRIOR ART
FIG. 2 is a perspective view of another conventional arm exercising device.

Before the present invention is described in greater detail, it should be noted that the same reference numerals have been used to denote like elements throughout the specification.

Figure 3:
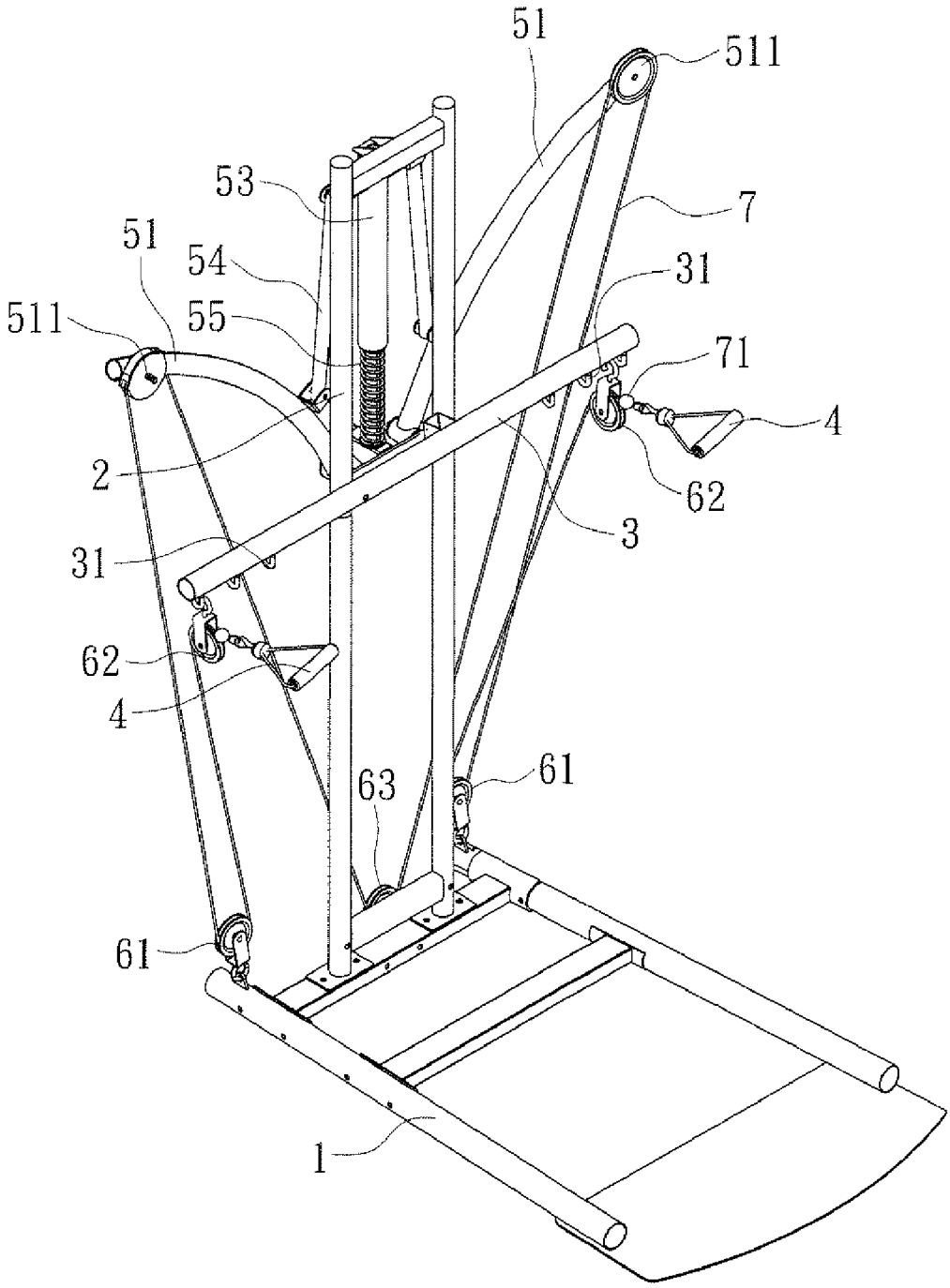
FIG. 3 is a perspective view of the first preferred embodiment of an arm exercising device according to this invention.
Figure 4:
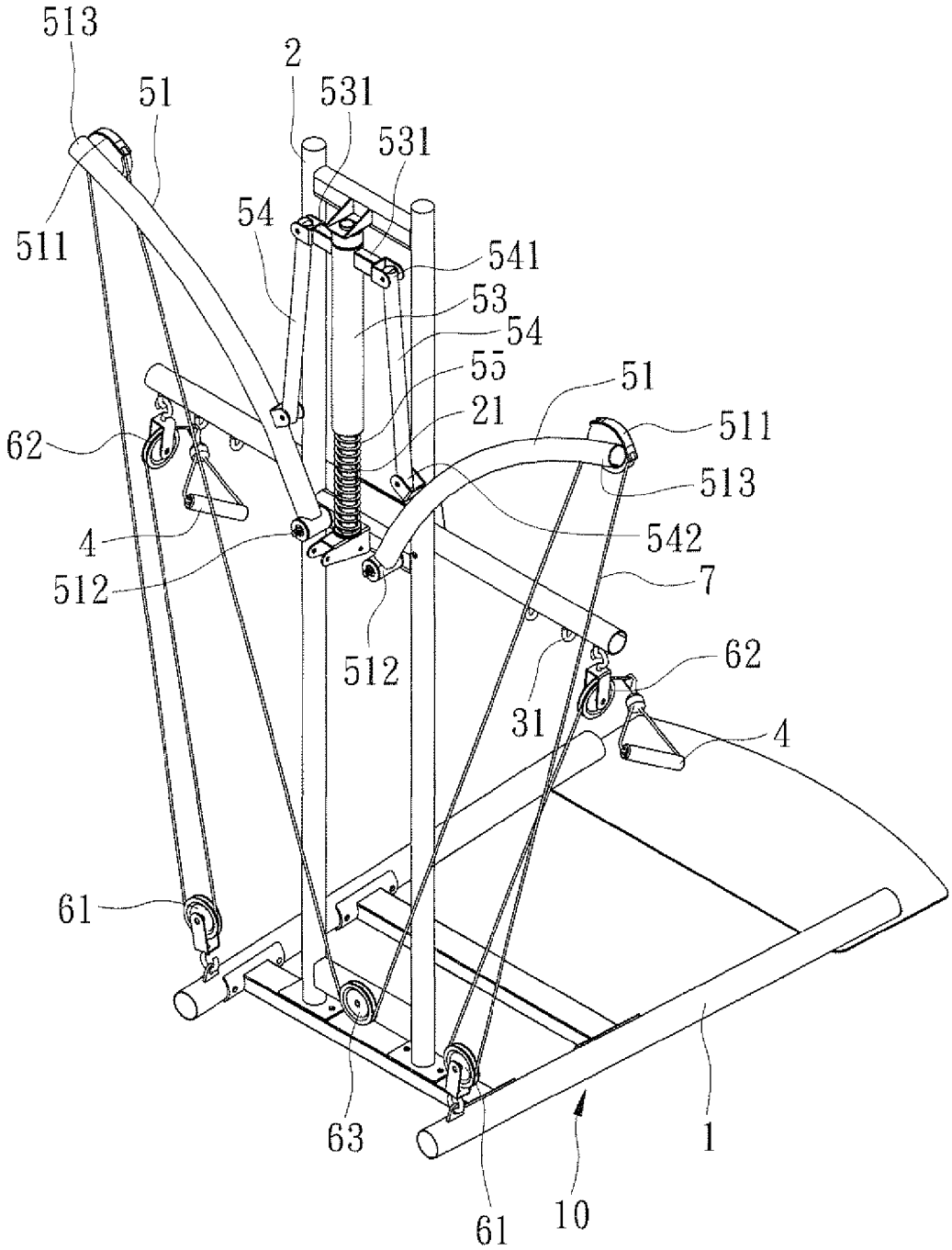
FIG. 4 is a perspective view of the first preferred embodiment viewed from a backside thereof.
Figure 5:
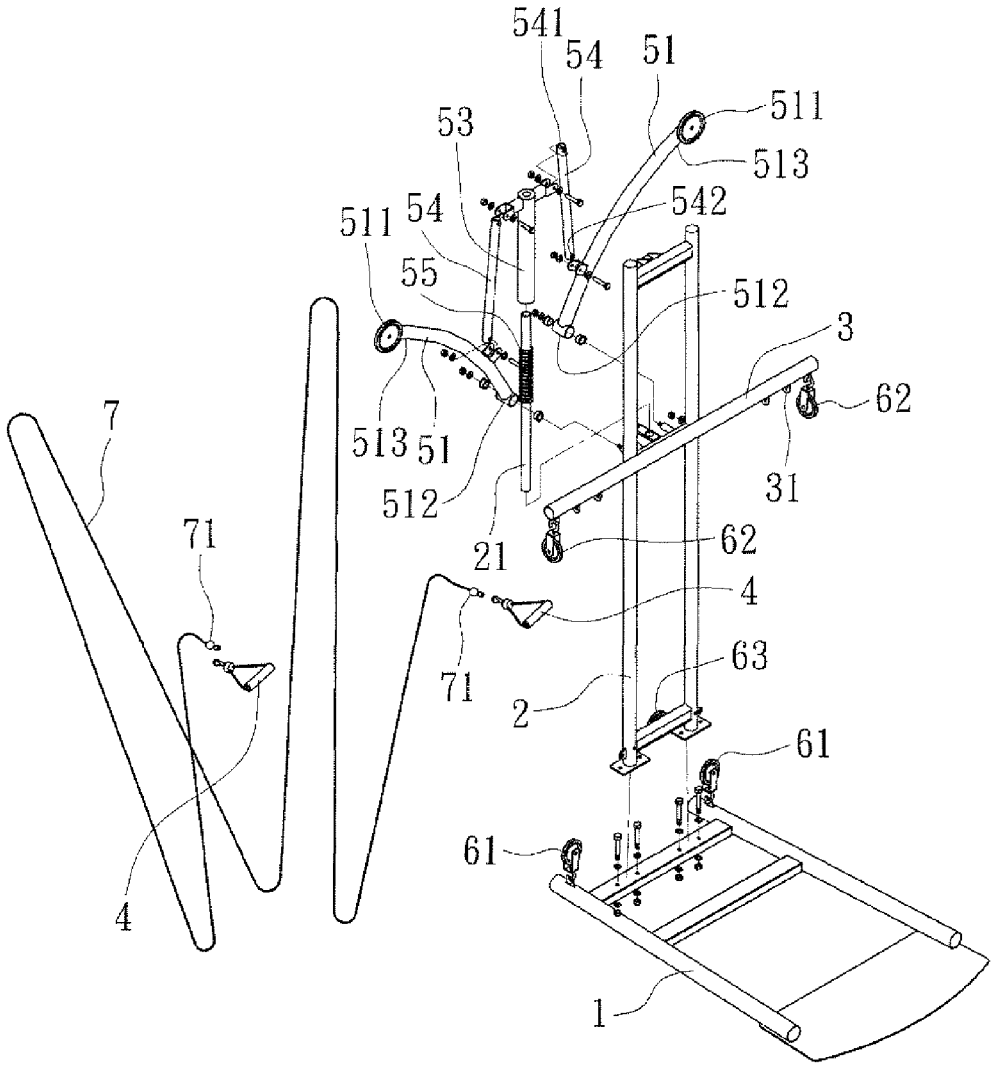
FIG. 5 is an exploded perspective view of the first preferred embodiment.

Referring to FIGS. 3 to 5, the first preferred embodiment of an arm exercising device according to the present invention is shown to comprise a frame 10, an impeding unit 55, and a linkage mechanism. The linkage mechanism includes a pair of swing arms 51, a runner sleeve 53, a pair of linking rods 54, a pair of handgrips 4, and a force transmitting cord 7.

The frame 10 includes a base 1, an upright support 2 fixed to the base 1 at a bottom end thereof and extending upward, and a transverse bar 3 mounted transversely on the upright support 2. The upright support 2 has a fixed guide rod 21 extending in a vertical direction. In particular, the guide rod 21 has top and bottom ends fixed to the upright support 2. Two lower pulleys 61 are mounted on the base 1 at two sides of the upright support 2. A middle pulley 63 is mounted on the bottom end of the upright support 2 and is interposed between the lower pulleys 61. The transverse bar 3 has a plurality of lugs 31 disposed at two ends thereof. Two upper pulleys 62 are each hung on a selected one of two of the lugs 31 so that the distance between the upper pulleys 62 can be adjusted.

Each of the swing arms 51 has a first end 512 connected pivotally to the upright support 2 in proximity to the bottom end of the guide rod 21 for swinging upward and downward, a second end 513 extending away from the upright support 2, and a swing arm pulley 511 attached to the second end 513.

The runner sleeve 53 is disposed slidably over the guide rod 21 for moving upward or downward, and has a pair of connectors 531 that are respectively disposed on opposite sides of the runner sleeve 53.

Each of the linking rods 54 has one end 541 connected pivotally to one of the connectors 531 and the other end 542 connected pivotally to one of the swing arms 51 between the first and second ends 512,513.

In this embodiment, the impeding unit 55 is in the form of a helical spring 55, preferably a compression spring, that is sleeved on the guide rod 21. The helical spring 55 has one end abutting against the runner sleeve 53 to apply a resistance force to the runner sleeve 53.

The force transmitting cord 7 is made of a steel material, and has two cord ends 71 which are respectively connected to the handgrips 4. The force transmitting cord 7 is disposed to consecutively pass over one of the upper pulleys 62, one of the lower pulleys 61, one of the swing arm pulleys 511, the middle pulley 63, the other one of the swing arm pulleys 511, the other one of the lower pulleys 61, and the other one of the upper pulleys 62.

By pulling the handgrips 4, the swing arms 51 are moved by the force transmitting cord 7. At this stage, the linking rods 54 connected to the swing arms 51 drive the runner sleeve 53 to move downward along the guide rod 21 to press the compression spring 55 such that a resistance force is generated and applied to the runner sleeve 53. The swing arms 51 and the runner sleeve 53 are interconnected through the linking rods 54 and the runner sleeve 53 is impeded by the compression spring 55. Accordingly, when the user operates the handgrips 4 to perform a stretching exercise, he/she will be subjected to substantially the same resistance force on each arm. Moreover, by virtue of the interconnection between the swing arms 51, it is convenient to adjust the resistance forces to be applied to two arms of the user.

It is noted that due to the adjustable distance between the upper pulleys 62, the positions of the handgrips 4 can be varied to suit different users.

Figure 6:
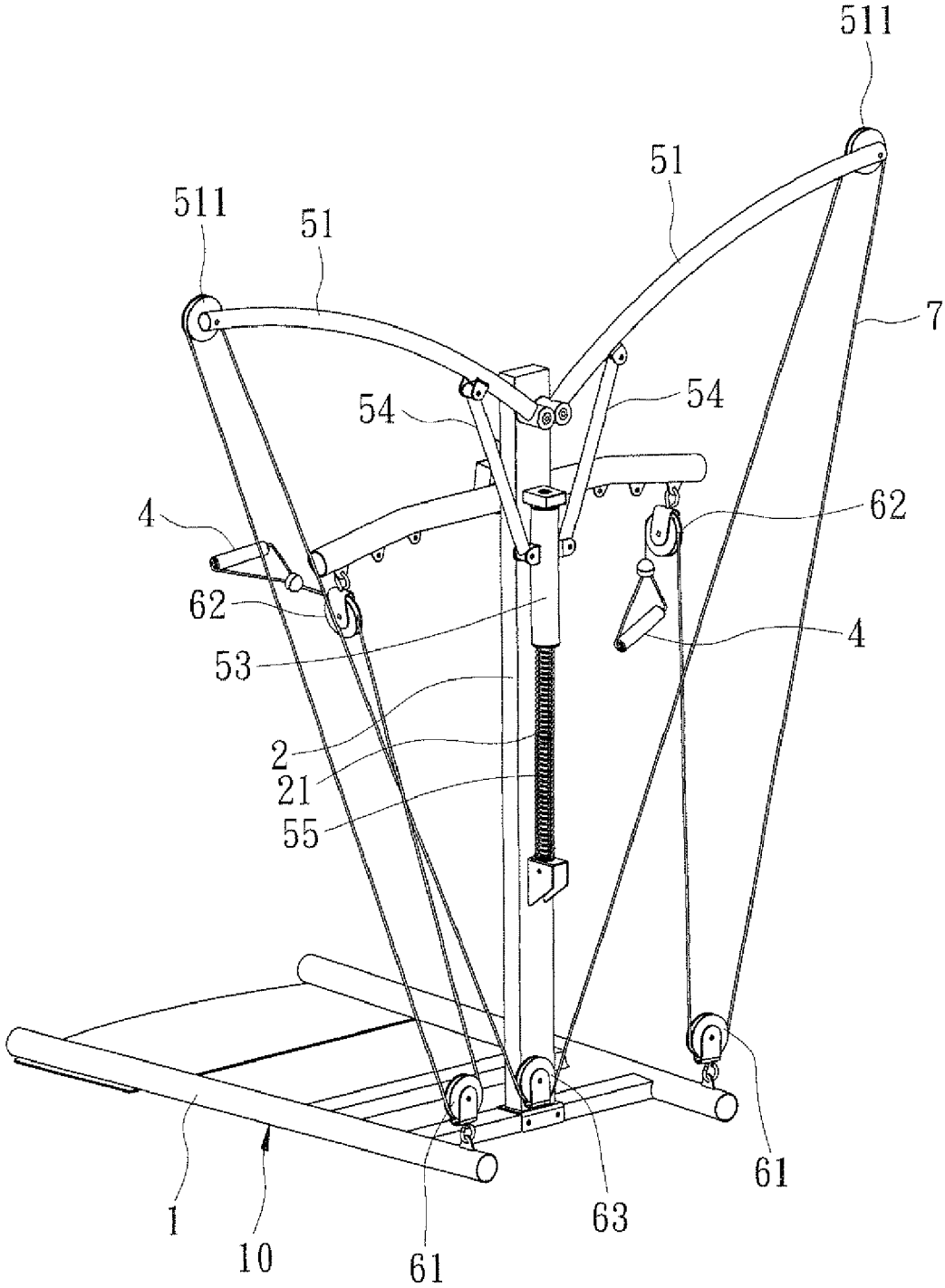
FIG. 6 is a perspective view illustrating a pair of swing arms of the first preferred embodiment mounted at a higher position.

Referring to FIG. 6, alternatively, the swing arms 51 may be connected to the upright support 2 above the guide rod 21.

Figure 7:
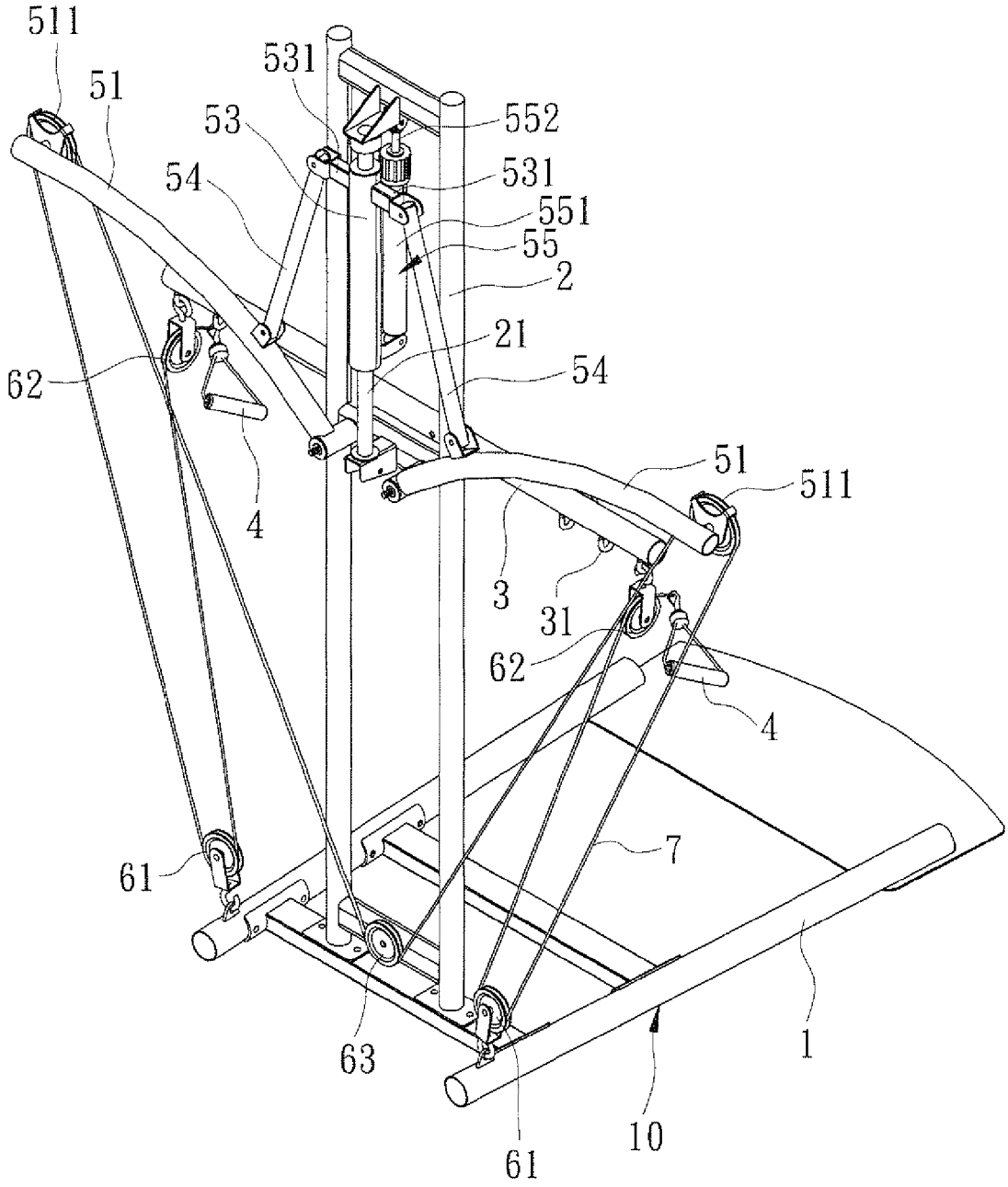
FIG. 7 is a perspective view of the second preferred embodiment of an arm exercising device according to this invention.

Referring to FIG. 7, the second preferred embodiment of the arm exercising device according to this invention is shown to be similar to that of the first embodiment in construction, except that the impeding unit 55 is in the form of a fluid or gas pressure actuated telescopic mechanism 55 that includes a hydraulic or pneumatic cylinder 551 connected to the runner sleeve 53, and a plunger 552 fixed to the upright support 2.

Figure 8:
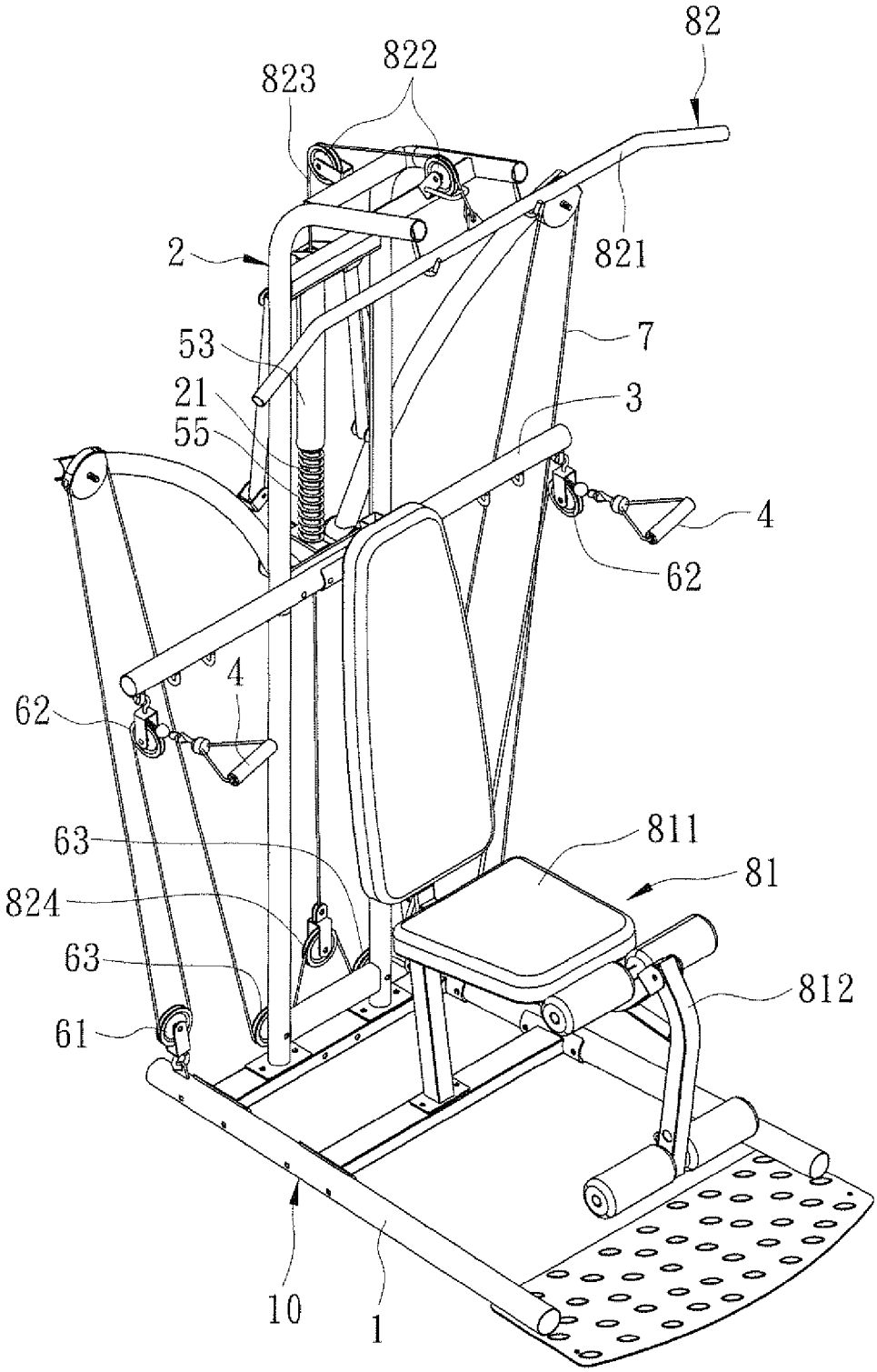
FIG. 8 is a perspective view of the third preferred embodiment of an arm exercising device according to this invention.

Referring to FIG. 8, the third preferred embodiment of the arm exercising device according to this invention is shown to be similar to that of the first embodiment in construction. In this embodiment, the arm exercising device further comprises a leg exercising unit 81 and a downward-pulling exercising unit 82. The leg exercising unit 81 includes a seat 811 and a weight-lifting member 812 rotatable relative to the seat 811. The downward-pulling exercising unit 82 includes a downward-pulling rod 821, two fixed pulleys 822 mounted on the upright support 2, a pulling cord 823 connected to the downward-pulling rod 821 and passing through the fixed pulleys 822 and the guide rod 21, and a movable pulley 824 connected to the pulling cord 823. In addition, two middle pulleys 63 are mounted on the bottom end of the upright support 2, and the force transmitting cord 7 is disposed to pass through the middle pulleys 63 and the movable pulley 824. Hence, the user can also perform a leg exercise and a downward-pulling exercise.

Figure 9:
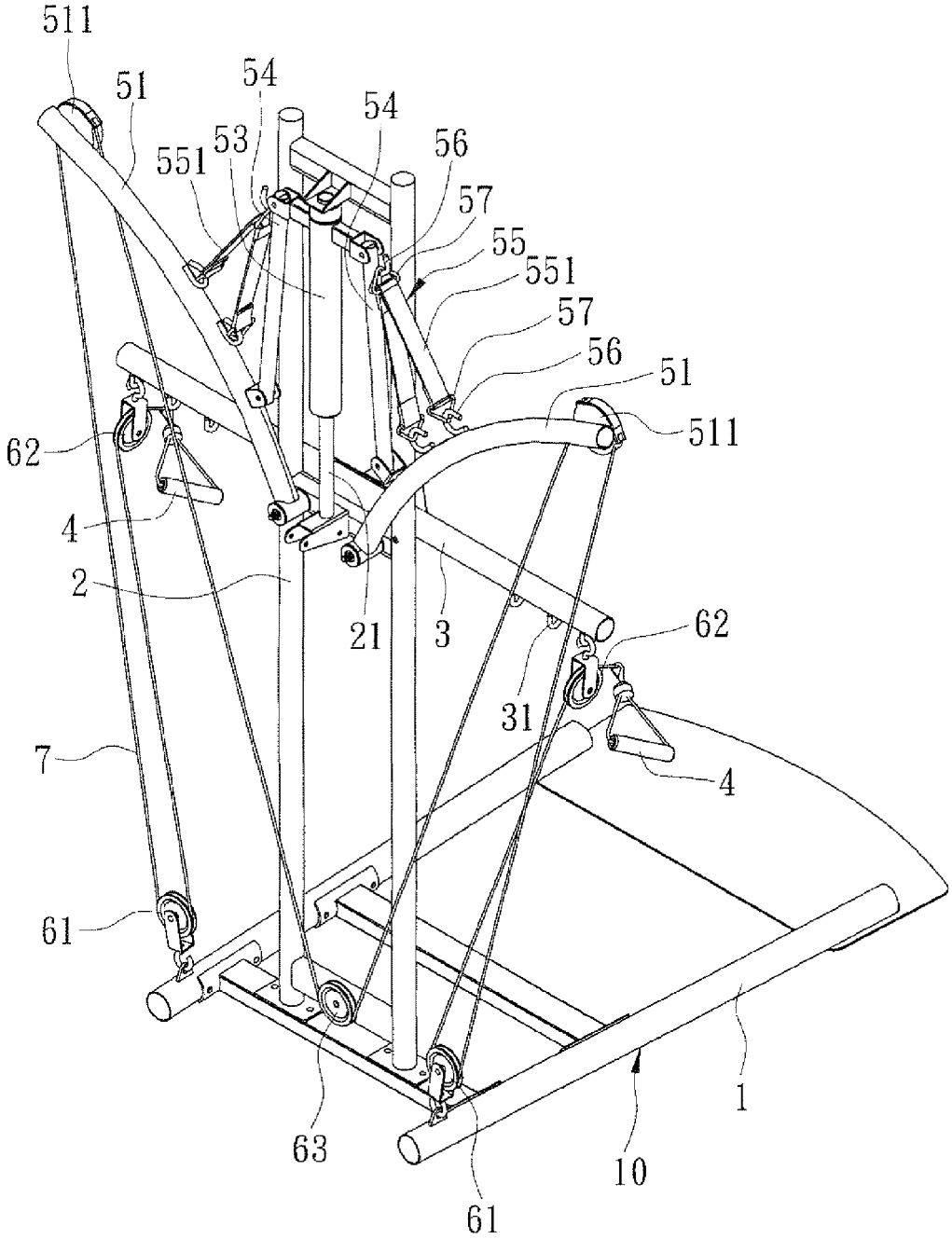
FIG. 9 is a perspective view of the fourth preferred embodiment of an arm exercising device according to this invention.

Referring to FIG. 9, the fourth preferred embodiment of the arm exercising device according to this invention is shown to be similar to that of the first embodiment in construction, except that the impeding unit 55 includes a plurality of elastic straps 551, each connected between one of the linking rods 54 and one of the swing arms 51. The quantity of elastic straps 551 connected to each of the swing arms 51 may be identical. Alternatively, each elastic strap 551 may be a tension spring.

Figure 10:
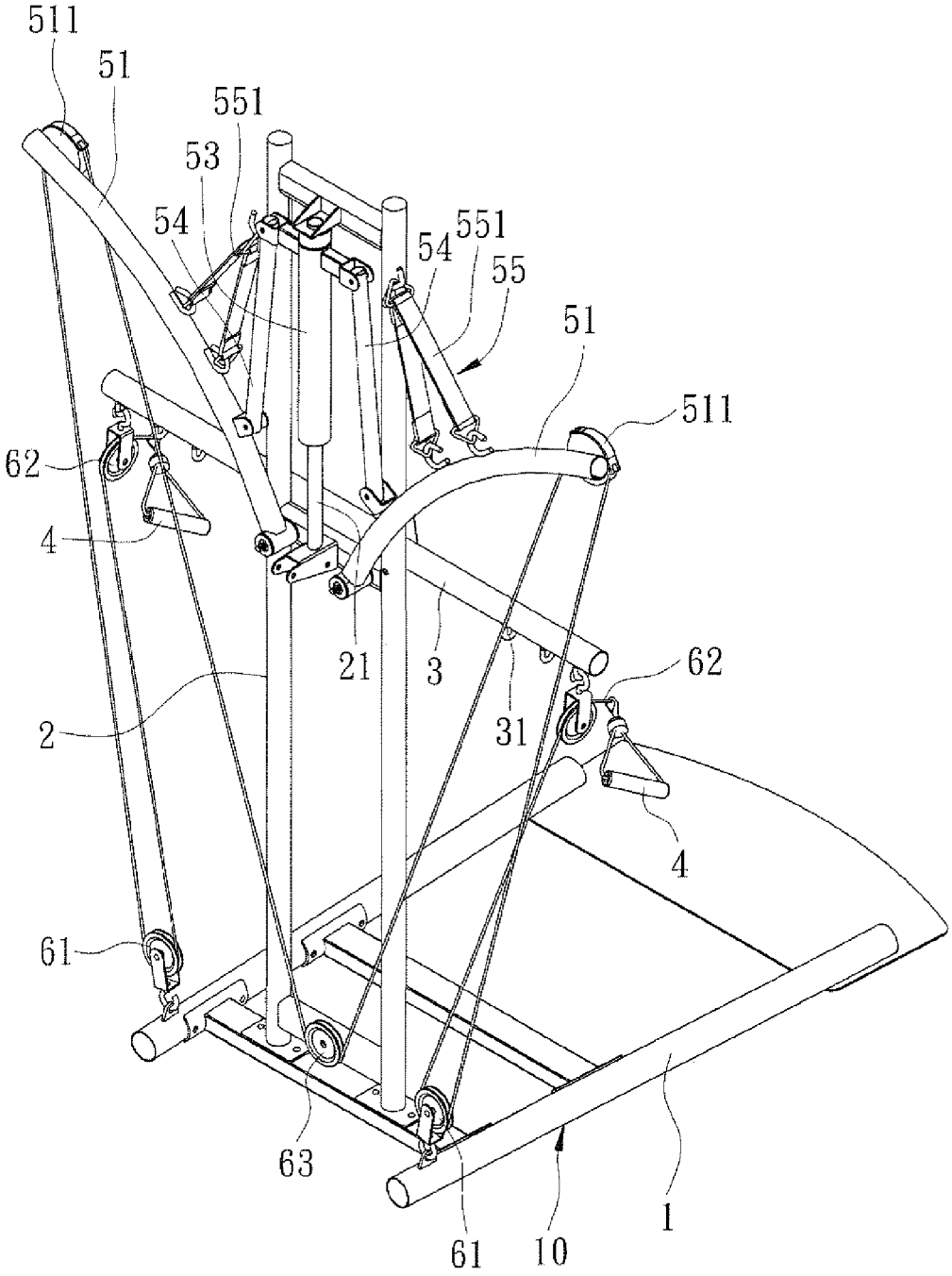
FIG. 10 is a perspective view of the fifth preferred embodiment of an arm exercising device according to this invention.

Referring to FIG. 10, in the fifth preferred embodiment, the impeding unit 55 includes a plurality of elastic straps 551, each connected between the upright support 2 and one of the swing arms 51. As illustrated, by virtue of arrangement of the handgrips 4, a single force transmitting cord 7, the single sleeve runner 53, the swing arms 51 and the linking rods 54, uniform resistance forces can be applied to each of the user's arms when the user grips the handgrips 4 and pulls downward, thereby enabling smooth and even arm exercises to occur. In addition, the resistance force provided by the impeding unit 55 may be conveniently adjusted.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An arm exercising device comprising:

a frame including an upright support that has a fixed guide rod; and a linkage mechanism including a pair of swing arms pivotally mounted on said upright support for swinging upward and downward, a runner sleeve disposed slidably over said guide rod for movement upward or downward, a pair of linking rods, each connected between said runner sleeve and one of said swing arms, a pair of handgrips, and a force transmitting cord connected to said handgrips and said swing arms.

2. The arm exercising device according to claim 1, wherein said guide rod extends in a vertical direction, said runner sleeve having a pair of connectors that are respectively disposed on two opposite sides of said runner sleeve and that are respectively connected to said linking rods.

3. The arm exercising device according to claim 2, wherein each of said linking rods has one end connected pivotally to one of said connectors and the other end connected pivotally to one of said swing arms.

4. The arm exercising device according to claim 3, wherein each of said swing arms has a first end connected pivotally to said upright support, a second end extending away from said upright support, and a swing arm pulley attached to said second end, said force transmitting cord passing over said swing arm pulley, said other end of each of said linking rods being connected pivotally to one of said swing arms between said first and second ends.

5. The arm exercising device according to claim 4, further comprising an impeding unit disposed to apply a resistance force to said linkage mechanism.

6. The arm exercising device according to claim 5, wherein said impeding unit includes a helical spring that is sleeved on said guide rod and that has one end abutting against said runner sleeve.

7. The arm exercising device according to claim 5, wherein said impeding unit includes a fluid pressure actuated telescopic mechanism that has one end fixed to said upright support and the other end connected to said runner sleeve.

8. The arm exercising device according to claim 5, wherein said impeding unit includes a plurality of elastic straps each connected between one of said linking rods and one of said swing arms.

9. The arm exercising device according to claim 5, wherein said impeding unit includes a plurality of elastic straps each connected between said upright support and one of said swing arms.

10. The arm exercising device according to claim 4, wherein said frame includes a base connected to a bottom end of said upright support, and a transverse bar mounted transversely on said upright support, said arm exercising device further comprising:

two upper pulleys mounted on two ends of said transverse bar;

two lower pulleys mounted on said base; and a middle pulley mounted on said bottom end of said upright support;

said force transmitting cord having two cord ends which respectively connect said handgrips, said force transmitting cord consecutively passing over one of said upper pulleys, one of said lower pulleys, one of said swing arm pulleys, said middle pulley, the other one of said swing arm pulleys, the other one of said lower pulleys, and the other one of said upper pulleys.

11. The arm exercising device according to claim 10, wherein said transverse bar has a plurality of lugs, and said upper pulleys are hung on two selected ones of said lugs.

* * * * *